US009991652B2

(12) United States Patent
Tsai et al.

(10) Patent No.: US 9,991,652 B2
(45) Date of Patent: Jun. 5, 2018

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Long-Fei Chen, New Taipei (TW); Yun-Jhong Wong, New Taipei (TW); Hung-Yu Chen, New Taipei (TW); Dong Xiang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days. days.

(21) Appl. No.: 15/471,654

(22) Filed: Mar. 28, 2017

(65) Prior Publication Data

US 2017/0288352 A1 Oct. 5, 2017

(30) Foreign Application Priority Data

Mar. 31, 2016 (CN) ..... 2016 2 0259133 U

(51) Int. Cl.

| | |
|---|---|
| ***H01R 13/648*** | (2006.01) |
| ***H01R 24/64*** | (2011.01) |
| ***H01R 13/516*** | (2006.01) |
| ***H01R 13/6585*** | (2011.01) |
| *H01R 107/00* | (2006.01) |

(52) U.S. Cl.

CPC ..... *H01R 24/64* (2013.01); *H01R 13/516* (2013.01); *H01R 13/6585* (2013.01); *H01R 2107/00* (2013.01)

(58) Field of Classification Search

CPC ..... H01R 13/6587; H01R 13/6594; H01R 23/6873; H01R 23/7073

USPC ..... 439/607.4, 607.35, 607.36, 607.37, 439/607.38, 926

See application file for complete search history.

(56) References Cited

U.S. PATENT DOCUMENTS

| | | | | |
|---|---|---|---|---|
| 8,292,674 | B1 * | 10/2012 | Yang | H01R 12/57 439/587 |
| 8,740,649 | B2 * | 6/2014 | Lan | H01R 13/506 439/607.4 |
| 9,252,542 | B2 * | 2/2016 | Little | H01R 13/6585 |

* cited by examiner

*Primary Examiner* — Phuong Dinh

(74) *Attorney, Agent, or Firm* — Muncy, Geissler, Olds & Lowe, P.C.

(57) ABSTRACT

An electrical receptacle connector includes a terminal module received in a metallic shell. The terminal module includes a base portion and receptacle terminals held on the base portion. A notch is recessed from a periphery of an insertion opening of the metallic shell. Therefore, when the electrical receptacle connector is assembled in an electronic device, the periphery of the notch corresponds to the periphery of a cut opening of a housing of the electronic device. The periphery of the cut opening and the periphery of the notch are aligned along the same profile line, and the periphery of the notch does not protrude out of the cut opening. Therefore, the periphery of the insertion opening will not interfere with other components assembled with the housing, and the problem of that the conventional design cannot satisfy the design change of the housing of the electronic device can be solved.

12 Claims, 7 Drawing Sheets

ELECTRICAL RECEPTACLE CONNECTOR

CROSS-REFERENCE TO RELATED APPLICATION

This non-provisional application claims priority under 35 U.S.C. § 119(a) to Patent Application No. 201620259133.5 filed in China, P.R.C. on Mar. 31, 2016, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, upper and lower receptacle terminals held on the plastic core, and an outer iron shell circularly enclosing the plastic core. The plastic core of the conventional connector is an assembly of several plastic pieces, and the upper and lower receptacle terminals are respectively combined with the plastic pieces.

SUMMARY OF THE INVENTION

However, in the conventional, the periphery of the insertion opening of the outer iron shell is flush; that is, the four sides of the periphery are on the same horizontal plane. As a result, when the conventional connector is assembled to a window of a housing of an electronic device (e.g., a housing of a notebook), because the window has a cut, the periphery of the insertion opening of the outer iron shell will protrude out of the cut. Hence, the periphery of the insertion opening of the outer iron shell will interfere with other components, or the conventional design cannot satisfy the design change of the space inside the housing of the electronic device. Therefore, how to solve the aforementioned problem is an issue.

In view of this, an embodiment of the instant disclosure provides an electrical receptacle connector. The electrical receptacle connector comprises a terminal module and a metallic shell. The terminal module comprises a base portion, a tongue portion outward extended from one end of the base portion, and a plurality of receptacle terminals. The receptacle terminals are held on the base portion. One of two ends of each of the receptacle terminals extends toward a first surface of the tongue portion or a second surface of the tongue portion opposite to the first surface, and the other end of each of the receptacle terminals protrudes out of the base portion. The metallic shell circularly encloses the terminal module. The metallic shell comprises a shell body, an insertion opening formed on one end of the shell body, and a receptacle cavity in the shell body. The shell body is defined by two opposite walls and two opposite sidewalls respectively perpendicular to the two walls. The shell body comprises at least one notch recessed from a periphery of the insertion opening and formed on one of the walls or one of the sidewalls.

In one embodiment, the metallic shell is covered by a housing. The housing comprises a window corresponding to the insertion opening and at least one cut opening recessed from a periphery of the window. A periphery of the at least one cut opening corresponds to a periphery of the at least one notch. The first surface or the second surface of the tongue portion is exposed from the at least one notch.

In one embodiment, the shell body comprises a plurality of notches. The notches are respectively recessed from the periphery of the insertion opening and formed on the walls. In addition, the first surface and the second surface of the tongue portion are respectively exposed from the notches.

In one embodiment, the shell body is formed by bending a board to have the two walls and the two sidewalls, and a cocktail-shaped slit is formed between peripheries of two connected ends of the board. Furthermore, the cocktail-shaped slit is formed in one of the walls, and one of two ends of the cocktail-shaped slit extends toward the periphery of the at least one notch.

In one embodiment, the shell body further comprises a plurality of side notches. The side notches respectively extend toward the sidewalls from two sides of the at least one notch.

As above, the notch is recessed from the periphery of the insertion opening of the metallic shell. In other words, the periphery of the insertion opening is cut, and the periphery of the insertion opening is not aligned along the same horizontal plane like that of a tubular member. Therefore, the periphery of the notch corresponds to the periphery of the cut opening of a housing of an electronic device. The periphery of the cut opening and the periphery of the notch are aligned along the same profile line, and the periphery of the notch does not protrude out of the cut opening. Therefore, the periphery of the insertion opening will not interfere with other components assembled with the housing, and the problem of that the conventional design cannot satisfy the design change of the space inside the housing of the electronic device can be solved.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
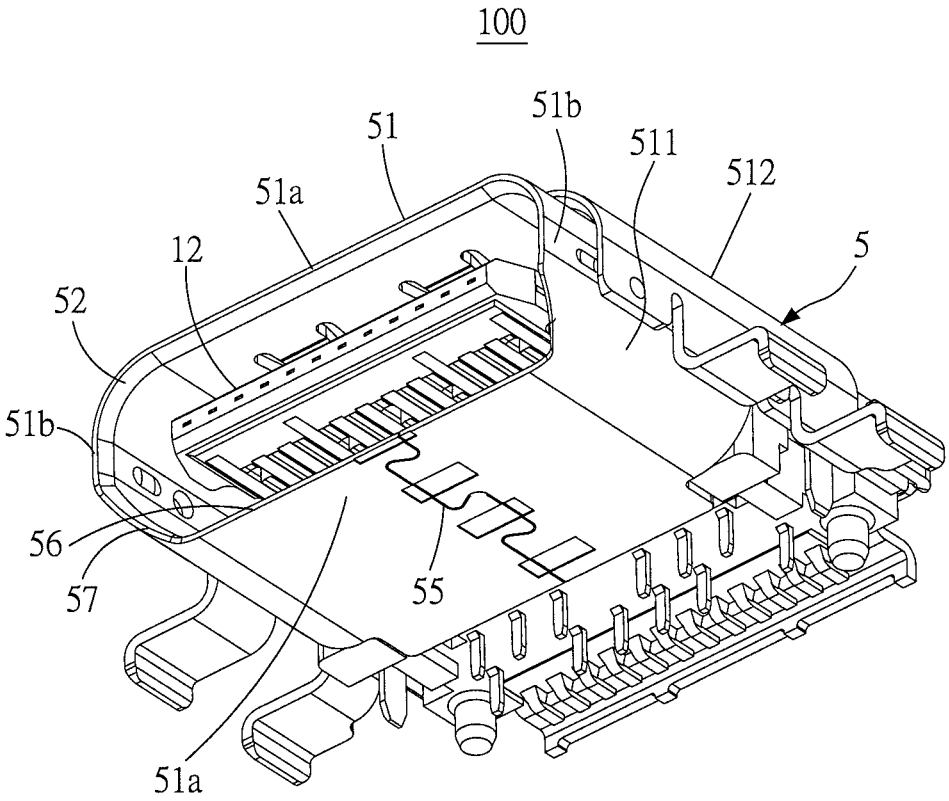
FIG. 1 illustrates a perspective view of an electrical receptacle connector of a first embodiment of the instant disclosure.
Figure 2:
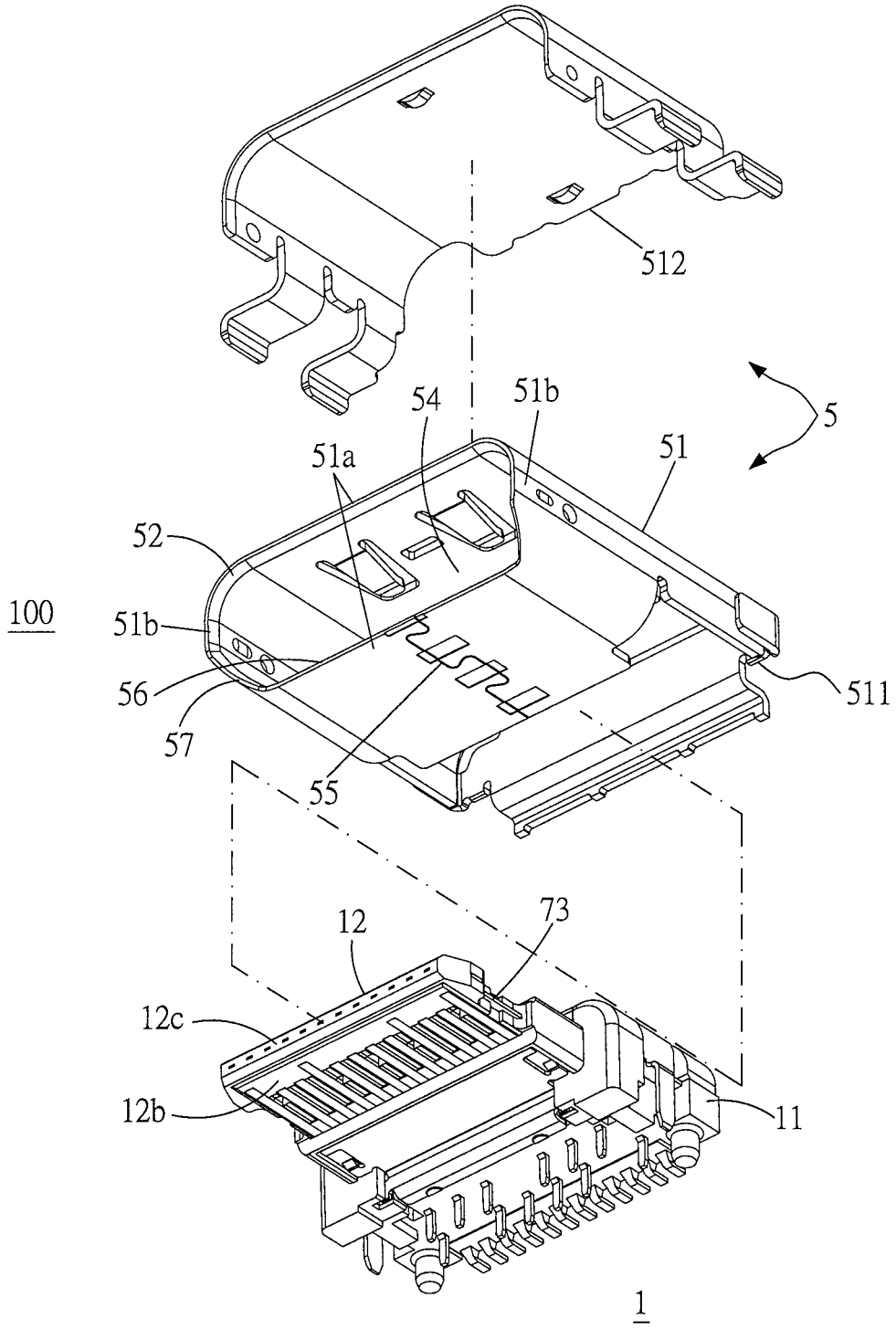
FIG. 2 illustrates an exploded view (1) of the electrical receptacle connector of the first embodiment.
Figure 3:
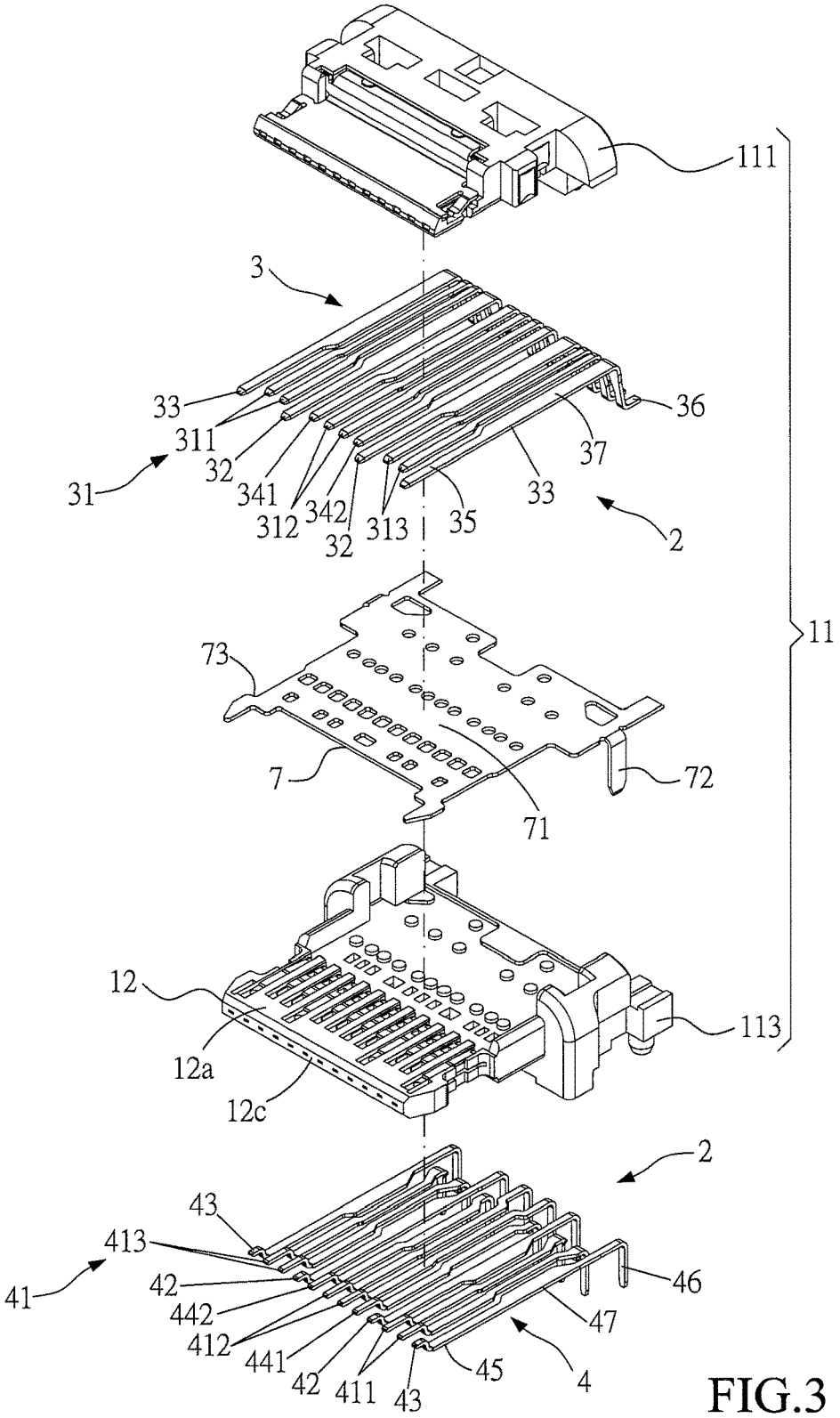
FIG. 3 illustrates an exploded view (2) of the electrical receptacle connector of the first embodiment.
Figure 6:
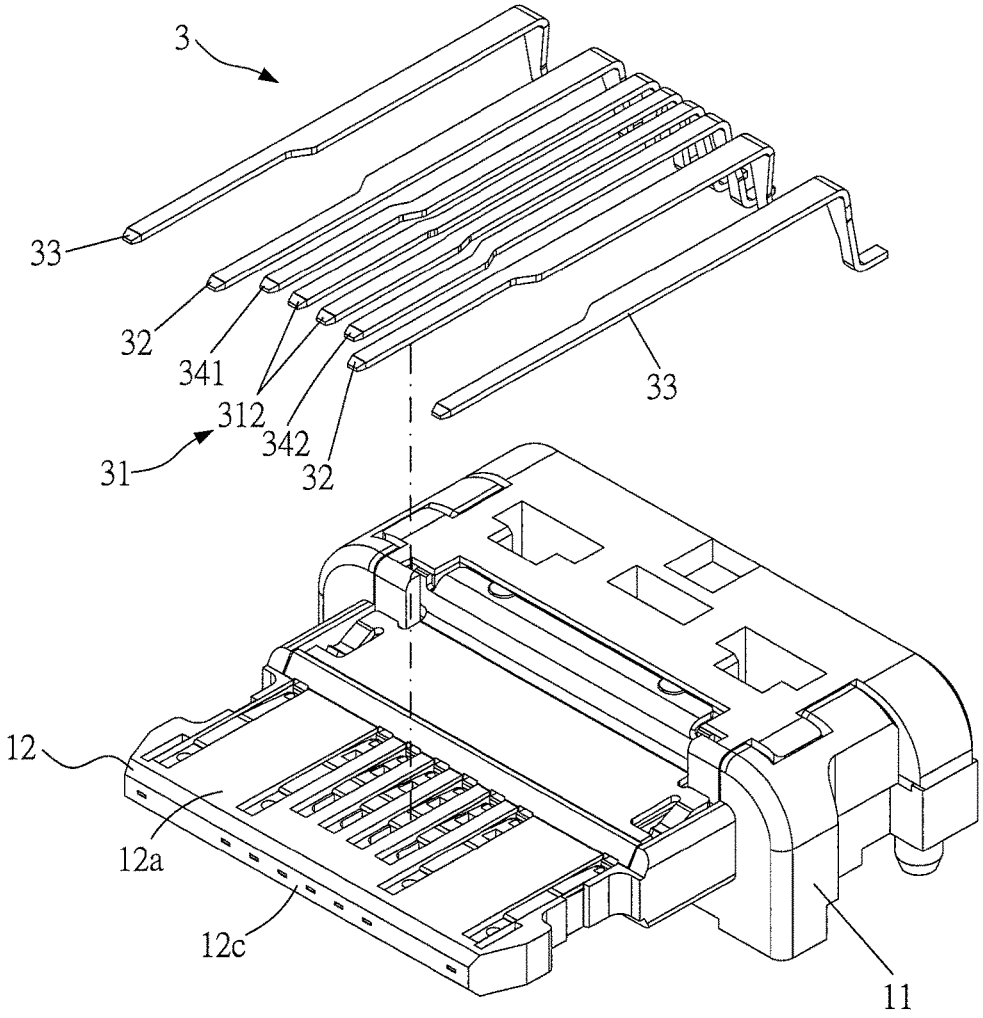
FIG. 6 illustrates an exploded view showing that receptacle terminals of the electrical receptacle connector are in a single row.

Please refer to FIGS. 1 to 3, illustrating an electrical receptacle connector of a first embodiment of the instant disclosure. FIG. 1 illustrates a perspective view of an electrical receptacle connector of the first embodiment of the instant disclosure. FIG. 2 illustrates an exploded view (1) of the electrical receptacle connector of the first embodiment. FIG. 3 illustrates an exploded view (2) of the electrical receptacle connector of the first embodiment. In this embodiment, the electrical receptacle connector 100 can provide a reversible or dual orientation USB Type-C connector interface and pin assignments, i.e., a USB Type-C receptacle connector. In this embodiment, the number of the receptacle terminals of the electrical receptacle connector 100 is suitable for USB 3.0 signal transmission, but embodiments are not limited thereto. In one embodiment, as shown in FIG. 6, the number of the receptacle terminals of the electrical receptacle connector 100 is suitable for USB 2.0 signal transmission, and in this case, the electrical receptacle connector 100 may be devoid of a shielding plate 7. In this embodiment, the electrical receptacle connector 100 comprises a terminal module 1 and a metallic shell 5.

Please refer to FIGS. 2 and 3. In this embodiment, the terminal module 1 comprises a base portion 11, a tongue portion 12, and a plurality of receptacle terminals 2. The tongue portion 12 outwardly extends from one end of the base portion 11. The receptacle terminals 2 are held in the base portion 11. In this embodiment, one of two ends of each of the receptacle terminals 2 extends toward two opposite surfaces of the tongue portion 12. In addition, the other end of each of the receptacle terminals 2 protrudes out of the base portion 11. In other words, in this embodiment, the receptacle terminals 2 on the base portion 11 are arranged in two rows, but embodiments are not limited thereto. In one embodiment, as shown in FIG. 6, the receptacle terminals 2 on the base portion 11 are arranged in one row.

Figure 4:
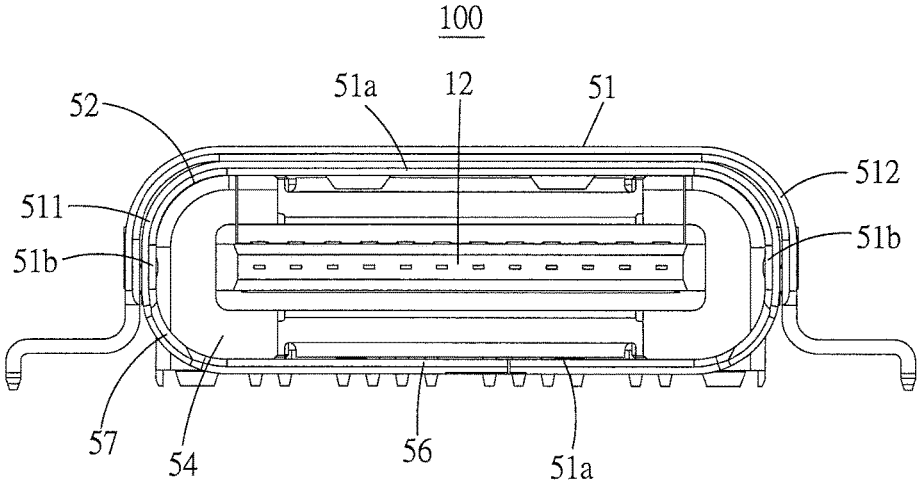
FIG. 4 illustrates a front view of the electrical receptacle connector of the first embodiment.

Please refer to FIGS. 2 to 4. FIG. 4 illustrates a front view of the electrical receptacle connector of the first embodiment. In this embodiment, the tongue portion 12 has two opposite surfaces, one is a first surface 12*a*, and the other is a second surface 12*b*. In addition, a front lateral surface 12*c* of the tongue portion 12 is connected the first surface 12*a* with the second surface 12*b* and is close to an insertion opening 52 of the metallic shell 5. In other words, the front lateral surface 12*c* is near the insertion opening 52 and perpendicularly connected to the first surface 12*a* and the second surface 12*b*, respectively.

Please refer to FIGS. 2 and 3. In this embodiment, the tongue portion 12 and the base portion 11 are formed integrally, and the tongue portion 12 is at one end of the base portion 11. In other words, the tongue portion 12 and the base portion 11 is the assembly of a first terminal base 111 and a second terminal base 113. First receptacle terminals 3 are held in the first terminal base 111. Second receptacle terminals 4 and a shielding plate 7 are held in the second terminal base 113. The second terminal base 113 and the tongue portion 12 are formed integrally. In this embodiment, the first terminal base 111 is assembled on the second terminal base 113, but embodiments are not limited thereto. In some embodiments, the first terminal base 111 and the second terminal base 113 may be formed integrally. In one embodiment, when the number of the receptacle terminals 2 of the electrical receptacle connector 100 is suitable for USB 3.0 signal transmission (as shown in FIG. 3), the electrical receptacle connector 100 further comprises the shielding plate 7 for shielding crosstalk interference between the receptacle terminals 2. In another embodiment, when the number of the receptacle terminals 2 of the electrical receptacle connector 100 is suitable for USB 2.0 signal transmission (as shown in FIG. 6), the electrical receptacle connector 100 may be devoid of the shielding plate 7.

Please refer to FIGS. 2 to 4. In this embodiment, the receptacle terminals 2 comprise first receptacle terminals 3 and second receptacle terminals 4, and the first receptacle terminals 3 and the second receptacle terminals 4 are respectively formed as upper-row terminals and lower-row terminals. Therefore, the receptacle terminals 3 are arranged in two rows, but embodiments are not limited thereto. In one embodiment, the receptacle terminals 2 are arranged in one row, and the receptacle terminals 2 may be the first receptacle terminals 3 (as shown in FIG. 6) or the second receptacle terminals 4.

Figure 5:
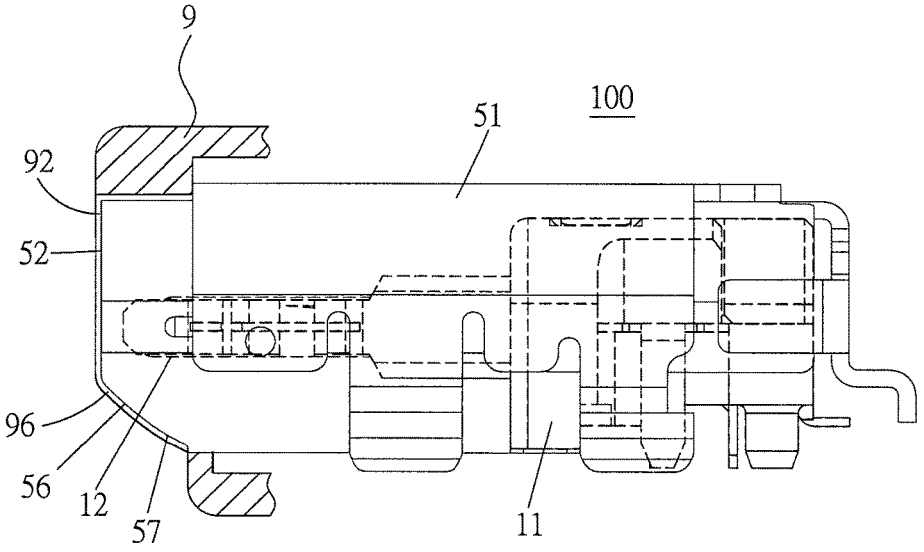
FIG. 5 illustrates a lateral view of the electrical receptacle connector of the first embodiment.

Please refer to FIGS. 2, 3, and 5. FIG. 5 illustrates a lateral view of the electrical receptacle connector of the first embodiment. In this embodiment, the first receptacle terminals 3 are assembled on the first terminal base 111. Two ends of each of the first receptacle terminals 3 respectively comprise a flat contact portion 35 and a tail portion 36. In other words, the tail portion 36 extends from one end of the flat contact portion 35. The flat contact portions 35 are positioned in terminal grooves on one of the two surfaces (i.e., the first surface 12*a* or the second surface 12*b*) of the tongue portion 12. The tail portions 36 protrude out of the base portion 11.

Please refer to FIGS. 2, 3, and 5. In this embodiment, the second receptacle terminals 4 and the shielding plate 7 are assembled on the second terminal base 113. Two ends of each of the second receptacle terminals 4 respectively comprise a flat contact portion 45 and a tail portion 46. In other words, the tail portion 46 extends from one end of the flat contact portion 45. The tail portions 46 protrude out of the base portion 11.

Please refer to FIGS. 3 to 5. The first receptacle terminals 3 comprise a plurality of first signal terminals 31, at least one power terminal 32, and at least one ground terminal 313. The first signal terminals 31 comprise a plurality of pairs of first signal terminals 311/313 and a pair of first low-speed signal terminals 312. From a front view of the first receptacle terminals 3, the first receptacle terminals 3 comprise, from left to right, a ground terminal 33 (Gnd), a first pair of first high-speed signal terminals 311 (TX1+−, differential signal terminals for high-speed signal transmission), a power terminal 32 (Power/VBUS), a first function detection terminal 341 (CC1, a terminal for inserting orientation detection of the connector and for cable recognition), a pair of first low-speed signal terminals 312 (D+−, differential signal terminals for low-speed signal transmission), a first supplement terminal 342 (SBU1, a terminal can be reserved for other purposes), another power terminal 32 (Power/VBUS), a second pair of first high-speed signal terminals 313 (RX2+−, differential signal terminals for high-speed signal transmission), and another ground terminal 33 (Gnd). In this embodiment, twelve first receptacle terminals 3 are provided for transmitting USB 3.0 signals. Each pair of the first high-speed signal terminals 311/313 is between the corresponding power terminal 32 and the adjacent ground terminal 33. The pair of the first low-speed signal terminals 312 is between the first function detection terminal 341 and the first supplement terminal 342.

Furthermore, in some embodiments, the rightmost ground terminal 33 (Gnd) (or the leftmost ground terminal 33 (Gnd)) or the first supplement terminal 342 (SBU1) can be further omitted. Therefore, the total number of the first receptacle terminals 3 can be reduced from twelve terminals to seven terminals. Furthermore, the ground terminal 33 (Gnd) may be replaced by a power terminal 32 (Power/VBUS) and provided for power transmission. In this embodiment, the width of the power terminal 32 (Power/VBUS) may be, but not limited to, equal to the width of the first signal terminal 31. In some embodiments, the width of the power terminal 32 (PowerNBUS) may be greater than the width of the first signal terminal 31 and an electrical receptacle connector 100 having the power terminal 32 (Power/VBUS) can be provided for large current transmission.

Please refer to FIGS. 2 to 5. The first receptacle terminals 3 are on the first terminal base 111 and formed as the upper-row terminals of the electrical receptacle connector 100. In this embodiment, each of the first receptacle terminals 3 comprises a flat contact portion 35, a body portion 37, and a tail portion 36. For each of the first receptacle terminals 3, the body portion 37 is held in the first terminal base 111, the flat contact portion 35 extends forward from the body portion 37 in the rear-to-front direction and is partly exposed upon the first surface 12*a* of the tongue portion 12, and the tail portion 36 extends backward from the body portion 37 in the front-to-rear direction and protrudes from the rear of the first terminal base 111. The first signal terminals 31 are disposed on the first surface 12*a* and transmit first signals (namely, USB 3.0 signals). The tail portions 36 extend from the body portions 37 and are bent horizontally to form flat legs, named legs manufactured by SMT (surface base portion technology), which can be mounted or soldered on the surface of a printed circuit board by using surface mount technology. In another embodiment, the tail portions 36 may extend from the body portions 37 downwardly to form vertical legs, named legs manufactured by through-hole technology, which can be inserted into holes drilled in a printed circuit board (PCB).

Please refer to FIGS. 3 to 5. The second receptacle terminals 4 comprise a plurality of second signal terminals 41, at least one power terminal 42, and at least one ground terminal 43. The second signal terminals 41 comprise a plurality of pairs of second signal terminals 411/413 and a pair of second low-speed signal terminal 412. From a front view of the second receptacle terminals 4, the second receptacle terminals 4 comprise, from right to left, a ground terminal 43 (Gnd), a first pair of second high-speed signal terminals 411 (TX2+−, differential signal terminals for high-speed signal transmission), a power terminal 42 (Power/VBUS), a second function detection terminal 441 (CC2, a terminal for inserting orientation detection of the connector and for cable recognition), a pair of second low-speed signal terminals 412 (D+−, differential signal terminals for low-speed signal transmission), a second supplement terminal 442 (SBU2, a terminal can be reserved for other purposes), another power terminals 42 (Power/VBUS), a second pair of second high-speed signal terminals 413 (RX1+−, differential signal terminals for high-speed signal transmission), and another ground terminal 43 (Gnd). In this embodiment, twelve second receptacle terminals 4 are provided for transmitting USB 3.0 signals. Each pair of the second high-speed signal terminals 411/413 is between the corresponding power terminal 42 and the adjacent ground terminal 43. The pair of the second low-speed signal terminals 412 is between the second function detection terminal 441 and the second supplement terminal 442.

Furthermore, in some embodiments, the rightmost ground terminal 43 (or the leftmost ground terminal 43) or the second supplement terminal 442 (SBU2) can be further omitted. Therefore, the total number of the second receptacle terminals 4 can be reduced from twelve terminals to seven terminals. Furthermore, the rightmost ground terminal 43 may be replaced by a power terminal 42 and provided for power transmission. In this embodiment, the width of the power terminal 42 (Power/VBUS) may be, but not limited to, equal to the width of the second signal terminal 41. In some embodiments, the width of the power terminal 42 (Power/VBUS) may be greater than the width of the second signal terminal 41 and an electrical receptacle connector 100 having the power terminal 42 (Power/VBUS) can be provided for large current transmission.

Please refer to FIGS. 2 to 5. The second receptacle terminals 4 are held in the second terminal base 113 and formed as the lower-row terminals of the electrical receptacle connector 100. The first receptacle terminals 3 are substantially aligned parallel with the second receptacle terminals 4. In this embodiment, each of the second receptacle terminals 4 comprises a flat contact portion 45, a body portion 47, and a tail portion 46. For each of the second receptacle terminals 4, the body portion 47 is held in the second terminal base 113 and the tongue portion 12, the flat contact portion 45 extends from the body portion 47 in the rear-to-front direction and is partly exposed upon the second surface 12*b* of the tongue portion 12, and the tail portion 416 extends backward from the body portion 47 in the front-to-rear direction and protrudes from the rear of the second terminal base 113. The second signal terminals 4 are disposed at the second surface 12*b* and transmit second signals (i.e., USB 3.0 signals). In addition, the tail portions 46 extend from the body portions 47 and bent horizontally to form flat legs, named legs manufactured by SMT (surface mount technology), which can be mounted or soldered on the surface of a printed circuit board by using surface mount technology. Alternatively, the tail portions 46 may extend downwardly to form vertical legs, named legs manufactured by through-hole technology, which can be inserted into holes drilled in a printed circuit board (PCB). The tail portions 36 and the tail portions 46 are arranged in a staggered manner from the top view.

Please refer to FIGS. 2 to 4. In some embodiment, the electrical receptacle connector 100 further comprises a shielding plate 7. The shielding plate 7 is in the base portion 11 and the tongue portion 12. The shielding plate 7 comprises a plate body 71 and a plurality of legs 72. The plate body 71 is between the flat contact portions 35 of the first receptacle terminals 3 and the flat contact portions 45 of the second receptacle terminals 4. Specifically, the plate body 71 may be lengthened and widened, so that the front of the plate body 71 is near the front lateral surface 12*c* of the tongue portion 12. Two sides of the plate body 71 protrude from two sides of the tongue portion 12 for being in contact with an electrical plug connector, and the rear of the plate body 71 is near the rear of the second terminal base 113. Accordingly, the plate body 71 can be disposed on the tongue portion 12 and the second terminal base 113, and the structural strength of the tongue portion 12 and the shielding performance of the tongue portion 12 can be improved.

Please refer to FIGS. 2, 4, and 5. In this embodiment, the metallic shell 5 is a hollowed shell, and the metallic shell 5 comprises a shell body 51, an insertion opening 52 formed on one end of the shell body 51, and a receptacle cavity 54 in the shell body 51. In other words, the metallic shell 5 defines the receptacle cavity 54 for receiving the terminal module 1. In this embodiment, the shell body 51 may be a tubular member and forms the receptacle cavity 54 therein. In this embodiment, the shell body 111 may be formed by a multi-piece member, and the shell body 51 further comprises an inner shell 511 and a cover shell 512. The inner shell 511 is also a tubular member and circularly encloses the terminal module 1. The cover shell 512 has a U-shape cross section and covers the top and the two sides of the inner shell 511, but embodiments are not limited thereto. In some embodiments, the cover shell may be a tubular member and circularly encloses the inner shell 511. Furthermore, the insertion opening 52 with oblong shaped is formed on one end of the shell body 51, and the insertion opening 52 communicates with the receptacle cavity 54.

Figure 9:
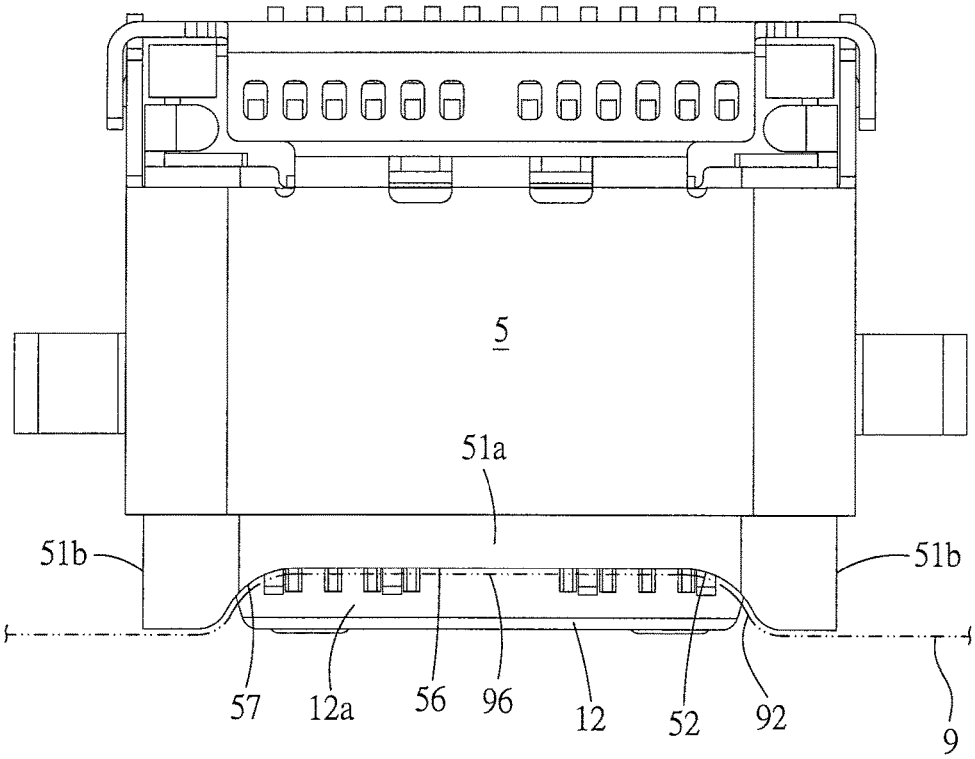
FIG. 9 illustrates a top view of the electrical receptacle connector of the second embodiment.

Please refer to FIGS. 2, 4, and 5. In this embodiment, the shell body 51 is defined by two opposite walls 51*a* and two opposite sidewalls 51*b*. The two sidewalls 51*b* are respectively perpendicular to the two walls 51*a*. In this embodiment, the shell body 51 comprises at least one notch 56. The notch 56 is recessed from a periphery of the insertion opening 52. In other words, the front periphery of the insertion opening 52 has a recessed edge, and the shell body 5 is not a tubular member having a complete periphery aligned along a single cross-sectional plane. In addition, one of two surfaces of the tongue portion 12 is exposed from the notch 56 (as shown in FIG. 9, the tongue portion 12 can be seen through the notch 56). The notch 56 is formed on the wall 51*a*, but embodiments are not limited thereto. In one embodiment, the notch 56 is formed on the sidewall 51*b*. In other words, the notch 56 may be recessed from any portion of the periphery of the insertion opening 52, and the position of the notch 56 corresponds to the housing 91 of an electronic device, as mentioned below.

Please refer to FIGS. 2, 4, and 5. In this embodiment, the shell body 51 further comprises a plurality of side notches 57. The side notches 57 respectively extend toward the sidewalls 51*b* from two sides of the notch 56. From a front projection view of the notch 56 and the side notches 57 (as shown in FIG. 9), the notch 56 and the side notches 57 are of trapezoid shape for corresponding to the housing 91 of the electronic device.

Please refer to FIGS. 2, 4, and 5. In this embodiment, the shell body 51 is formed by bending a board to have the two walls 51*a* and the two sidewalls 51*b*, and a cocktail-shaped slit 55 is formed between peripheries of two connected ends of the board. In one embodiment, during the stamping and cutting-off step, the notch 56 is formed on the board, and the length and the width of the notch 56 are determined in advance by choosing a proper stamping die. Next, after the stamping and cutting-off step, the board is bent to form the shell body 51. In this embodiment, the cocktail-shaped slit 55 is formed in the wall 51*a*, and one of two ends of the cocktail-shaped slit 55 extends toward the periphery of the notch 56, but embodiments are not limited thereto. In one embodiment, the cocktail-shaped slit 55 is formed in one of the two walls 51*a*, and the notch 56 is formed on the other wall 51*a*.

Please refer to FIGS. 2, 4, and 5, In this embodiment, the metallic shell 5 is covered by a housing 9 of an electronic device (e.g., a smartphone and a notebook). The housing 9 comprises a window 92 corresponding to the insertion opening 52 and at least one cut opening 96. The cut opening 96 is recessed from a periphery of the window 92. A periphery of the cut opening 96 corresponds to a periphery of the notch 56. The window 92 is for the insertion of an electrical plug connector. Please refer to FIG. 5. The periphery of the cut opening 96 corresponds to the periphery of the notch 56 means that, when the electrical receptacle connector 100 is assembled in the electronic device, the periphery of the notch 56 of the metallic shell 5 is aligned with the periphery of the cut opening 96. In other words, the periphery of the cut opening 96 and the periphery of the notch 56 are aligned along the same profile line, and the periphery of the notch 56 does not protrude out of the cut opening 96. Therefore, the periphery of the insertion opening 52 will not interfere with other components assembled with the housing 9, and the problem of that the conventional design cannot satisfy the design change of the space inside the housing 9 of the electronic device can be solved.

Figure 7:
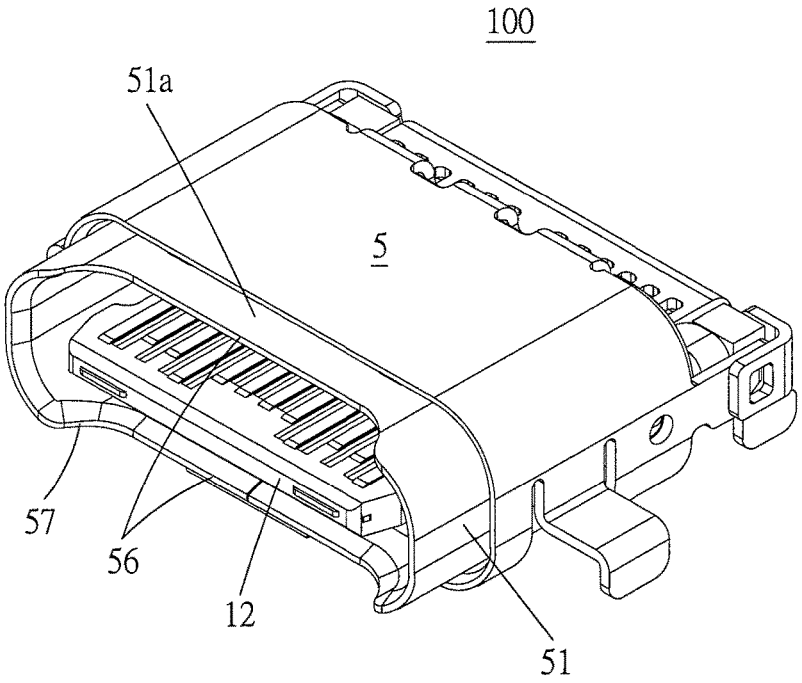
FIG. 7 illustrates a perspective view of an electrical receptacle connector of a second embodiment of the instant disclosure.
Figure 8:
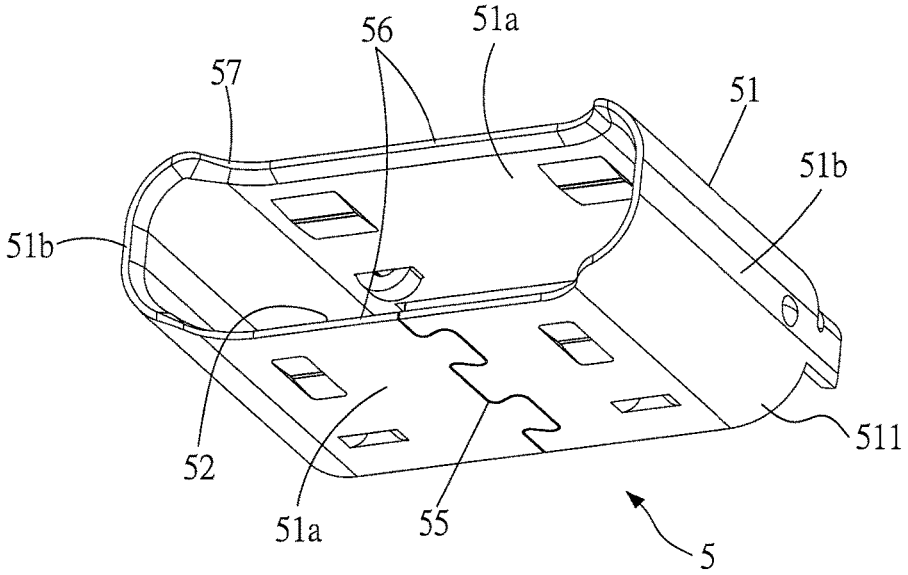
FIG. 8 illustrates a perspective view of a metallic shell of the electrical receptacle connector of the second embodiment from another viewing angle.

Please refer to FIGS. 7 to 9, illustrating an electrical receptacle connector of a second embodiment of the instant disclosure. FIG. 7 illustrates a perspective view of the electrical receptacle connector of the second embodiment. FIG. 8 illustrates a perspective view of a metallic shell of the electrical receptacle connector of the second embodiment. FIG. 9 illustrates a top view of the electrical receptacle connector of the second embodiment. In this embodiment, the shell body 51 further comprises a plurality of notches 56. The notches 56 are respectively recessed from the periphery of the insertion opening 52. The notches 56 are respectively formed on the walls 51*a*. In addition, two surfaces of the tongue portion 12 (i.e., the first surface 12*a* and the second surface 12*b*) are respectively exposed from the notches 56 (as shown in FIG. 9, the tongue portion 12 can be seen through the notch 56). In this embodiment, the notches 56 are respectively on the walls 51*a* and have corresponding positions, but embodiments are not limited thereto. Each of the notches 56 may be formed on any portion of the wall 51*a*, and the notches 56 are respectively on the walls 51*a* but with non-corresponding positions. It is understood that, the position of each of the notches 56 corresponds to the position of the corresponding cut opening 96 of the housing 9.

Please refer to FIGS. 2 to 4. The legs 72 of the shielding plate 7 extend downward from the rear portion of the shielding plate 7 to form vertical legs. That is, the legs 72 are exposed from the second terminal base 113 and in contact with the circuit board. In this embodiment, the crosstalk interference can be reduced by the shielding of the shielding plate 7 when the flat contact portions 35, 45 transmit signals. Furthermore, the structural strength of the tongue portion 12 can be improved by the assembly of the shielding plate 7. In addition, the legs 72 of the shielding plate 7 are exposed from the second terminal base 113 and in contact with the circuit board for conduction and grounding.

Please refer to FIGS. 2 and 3. The shielding plate 7 further comprises a plurality of hooks 73. The hooks 73 extend outward from two sides of the plate body 71, and the hooks 73 protrude from the front lateral surface 12*c* and two sides of the tongue portion 12. When an electrical plug connector is mated with the electrical receptacle connector 100, elastic pieces at two sides of an insulated housing of the electrical plug connector are engaged with the hooks 73, and the elastic pieces would not wear against the tongue portion 12 of the electrical receptacle connector 100. Hence, the shielding plate 7 can be in contact with the metallic shell of the plug connector for conduction and grounding.

Please refer to FIGS. 2 to 4. In this embodiment, the first receptacle terminals 3 and the second receptacle terminals 4 are disposed upon the first surface 12*a* and the second surface 12*b* of the tongue portion 12, respectively, and pin-assignments of the first receptacle terminals 3 and the second receptacle terminals 4 are point-symmetrical with a central point of the receptacle cavity 54 as the symmetrical center. In other words, pin-assignments of the first receptacle terminals 3 and the second receptacle terminals 4 have 180-degree symmetrical design with respect to the central point of the receptacle cavity 54 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 3 (or the second receptacle terminals 4), are rotated by 180 degrees with the symmetrical center as the rotating center, the first receptacle terminals 3 and the second receptacle terminals 4 are overlapped. That is, the rotated first receptacle terminals 3 are arranged at the position of the original second receptacle terminals 4, and the rotated second receptacle terminals 4 are arranged at the position of the original first receptacle terminals 3. In other words, the first receptacle terminals 3 and the second receptacle terminals 4 are arranged upside down, and the pin assignments of the flat contact portions 35 are left-right reversal with respect to that of the flat contact portions 45. An electrical plug connector is inserted into the electrical receptacle connector 100 with a first orientation where the first surface 12*a* is facing up, for transmitting first signals. Conversely, the electrical plug connector is inserted into the electrical receptacle connector 100 with a second orientation where the first surface 12*a* is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Additionally, in some embodiments, the electrical receptacle connector 100 is devoid of the first receptacle terminals 3 (or the second receptacle terminals 4) when an electrical plug connector to be mated with the electrical receptacle connector 100 has upper and lower plug terminals. In the case that the first receptacle terminals 3 are omitted, the upper plug terminals or the lower plug terminals of the electrical plug connector are in contact with the second receptacle terminals 4 of the electrical receptacle connector 100 when the electrical plug connector is inserted into the electrical receptacle connector 100 with the dual orientations. Conversely, in the case that the second receptacle terminals 4 are omitted, the upper plug terminals or the lower plug terminals of the electrical plug connector are in contact with the first receptacle terminals 3 of the electrical receptacle connector 100 when the electrical plug connector is inserted into the electrical receptacle connector 100 with the dual orientations.

Please refer to FIGS. 2 to 4. In this embodiment, as viewed from the front of the receptacle terminals 3, 4, the position of the first receptacle terminals 3 corresponds to the position of the second receptacle terminals 4. In other words, the positions of the flat contact portions 35 are respectively aligned with the positions of the flat contact portions 45, but embodiments are not limited thereto. In some embodiments, the first receptacle terminals 3 may be aligned by an offset with respect to the second receptacle terminals 4. That is, the flat contact portions 35 are aligned by an offset with respect to the flat contact portions 45. Accordingly, because of the offset alignment of the flat contact portions 35, 45, the crosstalk between the first receptacle terminals 3 and the second receptacle terminals 4 can be reduced during signal transmission. It is understood that, when the receptacle terminals 3, 4 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 3, 4 of the electrical receptacle connector 100 for power or signal transmission.

In the foregoing embodiments, the receptacle terminals 3, 4 are provided for transmitting USB 3.0 signals, but embodiments are not limited thereto. In some embodiments, for the first receptacle terminals 3 in accordance with transmission of USB 2.0 signals, the first pair of the first high-speed signal terminals 311 (TX1+−) and the second pair of the first high-speed signal terminals 313 (RX2+−) are omitted, and the pair of the first low-speed signal terminals 312 (D+−) and the power terminals 32 (Power/VBUS) are retained.

While for the second receptacle terminals 4 in accordance with transmission of USB 2.0 signals, the first pair of the second high-speed signal terminals 411 (TX2+−) and the second pair of the second high-speed signal terminals 413 (RX1+−) are omitted, and the pair of the second low-speed signal terminals 412 (D+−) and the power terminals 42 (Power/VBUS) are retained.

As above, the notch is recessed from the periphery of the insertion opening of the metallic shell. In other words, the periphery of the insertion opening is cut, and the periphery of the insertion opening is not aligned along the same horizontal plane like that of a tubular member. Therefore, the periphery of the notch corresponds to the periphery of the cut opening of a housing of an electronic device. The periphery of the cut opening and the periphery of the notch are aligned along the same profile line, and the periphery of the notch does not protrude out of the cut opening. Therefore, the periphery of the insertion opening will not interfere with other components assembled with the housing, and the problem of that the conventional design cannot satisfy the design change of the space inside the housing of the electronic device can be solved.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a terminal module comprising a base portion, a tongue portion outward extended from one end of the base portion, and a plurality of receptacle terminals held in the base portion, wherein one of two ends of each of the receptacle terminals extends toward a first surface of the tongue portion or a second surface of the tongue portion opposite to the first surface, and the other end of each of the receptacle terminals protrudes out of the base portion;

a metallic shell enclosing the terminal module, wherein the metallic shell comprises a shell body, an insertion opening formed on one end of the shell body, and a receptacle cavity in the shell body, wherein the shell body is defined by two opposite walls and two opposite sidewalls, the shell body comprises at least one notch recessed from a periphery of the insertion opening and formed on one of the walls or one of the sidewalls; and a housing covering the metallic shell, wherein the housing comprises a window corresponding to the insertion opening and at least one cut opening recessed from a periphery of the window, a periphery of the at least one cut opening corresponds to a periphery of the at least one notch.

2. The electrical receptacle connector according to claim 1, wherein the first surface or the second surface of the tongue portion is exposed from the at least one notch wherein the first surface or the second surface of the tongue portion is exposed from the at least one notch.

3. The electrical receptacle connector according to claim 1, wherein the shell body is formed by bending a board to have the two walls and the two sidewalls, a cocktail-shaped slit is formed between peripheries of two connected ends of the board.

4. The electrical receptacle connector according to claim 3, wherein the cocktail-shaped slit is formed in one of the walls, and one of two ends of the cocktail-shaped slit extends toward the periphery of the at least one notch.

5. The electrical receptacle connector according to claim 1, wherein the shell body further comprises a plurality of side notches, the side notches respectively extend toward the sidewalls from two sides of the at least one notch.

6. The electrical receptacle connector according to claim 1, wherein the receptacle terminals further comprise a plurality of first receptacle terminals and a plurality of second receptacle terminals, one ends of the first receptacle terminals extend toward the first surface, and one ends of the second receptacle terminals extend toward a second surface opposite to the first surface of the tongue portion.

7. The electrical receptacle connector according to claim 6, wherein the terminal module further comprises a shielding plate between the base portion and the tongue portion, the shielding plate is between the first receptacle terminals and the second receptacle terminals.

8. The electrical receptacle connector according to claim 1, wherein the metallic shell circularly encloses the terminal module.

9. The electrical receptacle connector according to claim 1, wherein the two opposite sidewalls are respectively perpendicular to the two walls.

10. An electrical receptacle connector, comprising:

a terminal module comprising a base portion, a tongue portion outward extended from one end of the base portion, and a plurality of receptacle terminals held in the base portion, wherein one of two ends of each of the receptacle terminals extends toward a first surface of the tongue portion or a second surface of the tongue portion opposite to the first surface, and the other end of each of the receptacle terminals protrudes out of the base portion; and a metallic shell enclosing the terminal module, wherein the metallic shell comprises a shell body, an insertion opening formed on one end of the shell body, and a receptacle cavity in the shell body, wherein the shell body is defined by two opposite walls and two opposite sidewalls, wherein the shell body comprises a plurality of notches, wherein the notches are respectively recessed from the periphery of the insertion opening and formed on the walls, and wherein the first surface and the second surface of the tongue portion are respectively exposed from the notches.

11. The electrical receptacle connector according to claim 10, wherein the metallic shell circularly encloses the terminal module.

12. The electrical receptacle connector according to claim 10, wherein the two opposite sidewalls are respectively perpendicular to the two walls.

* * * * *